US006059071A

United States Patent [19]

Appezzato

[11] Patent Number: 6,059,071

[45] Date of Patent: May 9, 2000

[54] SAWHORSE

[76] Inventor: Marc Appezzato, 801 Garden St., Rahway, N.J. 07065

[21] Appl. No.: 09/324,646

[22] Filed: Jun. 3, 1999

[51] Int. Cl.[7] ..... B27B 21/00

[52] U.S. Cl. ..... 182/181.1; 182/186.5

[58] Field of Search ..... 182/181.1, 155, 182/186.5, 186.4, 724, 151

[56] References Cited

U.S. PATENT DOCUMENTS

| | | | |
|---|---|---|---|
| 467,081 | 1/1892 | Church | 182/186.3 |
| 1,147,668 | 7/1915 | Anderson | 182/186.3 |
| 2,698,771 | 1/1955 | O'Rourk | 182/186.3 |
| 3,414,080 | 12/1968 | Doucette | 182/155 |
| 4,747,469 | 5/1988 | Phillips | 182/224 |
| 5,362,020 | 11/1994 | Brown | 182/155 |

*Primary Examiner*—Alvin Chin-Shue

[57] ABSTRACT

A sawhorse for supporting items thereon. The sawhorse includes an elongate cross bar and a plurality of legs. The cross bar has a pair of opposite ends, top and bottom faces, and a pair of side faces. Each end of the cross bar has a pair of downwardly sockets thereadjacent. Each of the legs is associated with a corresponding socket. The legs each have a deployed position where an end of the respective leg is inserted into the associated corresponding socket such that the legs downwardly extend from the cross bar. Each side face of the cross bar has an elongate channel therein. The legs also have a stored position where a first pair of legs of the plurality of legs are inserted into one of the elongate channels and a second pair of legs of the plurality of legs are inserted into the other of the elongate channels.

9 Claims, 2 Drawing Sheets

SAWHORSE

BACKGROUND OF THE INVENTION

1. Field of the Invention

The present invention relates to sawhorses and more particularly pertains to a new sawhorse for supporting items thereon.

2. Description of the Prior Art

The use of sawhorses is known in the prior art. More specifically, sawhorses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,763,958; U.S. Pat. No. 4,890,693; U.S. Pat. No. 5,314,041; U.S. Pat. No. 4,923,051; U.S. Pat. No. 4,319,663; and U.S. Pat. No. Des. 379,236.

While these devices fulfill their respective, particular objectives and requirements, the aforementioned patents do not disclose a new sawhorse. The inventive device includes an elongate cross bar and a plurality of legs. The cross bar has a pair of opposite ends, top and bottom faces, and a pair of side faces. Each end of the cross bar has a pair of downwardly sockets thereadjacent. Each of the legs is associated with a corresponding socket. The legs each have a deployed position where an end of the respective leg is inserted into the associated corresponding socket such that the legs downwardly extend from the cross bar. Each side face of the cross bar has an elongate channel therein. The legs also have a stored position where a first pair of legs of the plurality of legs are inserted into one of the elongate channels and a second pair of legs of the plurality of legs are inserted into the other of the elongate channels.

In these respects, the sawhorse according to the present invention substantially departs from the conventional concepts and designs of the prior art, and in so doing provides an apparatus primarily developed for the purpose of supporting items thereon.

SUMMARY OF THE INVENTION

In view of the foregoing disadvantages inherent in the known types of sawhorses now present in the prior art, the present invention provides a new sawhorse construction wherein the same can be utilized for supporting items thereon.

The general purpose of the present invention, which will be described subsequently in greater detail, is to provide a new sawhorse apparatus and method which has many of the advantages of the sawhorses mentioned heretofore and many novel features that result in a new sawhorse which is not anticipated, rendered obvious, suggested, or even implied by any of the prior art sawhorses, either alone or in any combination thereof.

To attain this, the present invention generally comprises an elongate cross bar and a plurality of legs. The cross bar has a pair of opposite ends, top and bottom faces, and a pair of side faces. Each end of the cross bar has a pair of downwardly sockets thereadjacent. Each of the legs is associated with a corresponding socket. The legs each have a deployed position where an end of the respective leg is inserted into the associated corresponding socket such that the legs downwardly extend from the cross bar. Each side face of the cross bar has an elongate channel therein. The legs also have a stored position where a first pair of legs of the plurality of legs are inserted into one of the elongate channels and a second pair of legs of the plurality of legs are inserted into the other of the elongate channels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sawhorse apparatus and method which has many of the advantages of the sawhorses mentioned heretofore and many novel features that result in a new sawhorse which is not anticipated, rendered obvious, suggested, or even implied by any of the prior art sawhorses, either alone or in any combination thereof.

It is another object of the present invention to provide a new sawhorse which may be easily and efficiently manufactured and marketed.

It is a further object of the present invention to provide a new sawhorse which is of a durable and reliable construction.

An even further object of the present invention is to provide a new sawhorse which is susceptible of a low cost of manufacture with regard to both materials and labor, and which accordingly is then susceptible of low prices of sale to the consuming public, thereby making such sawhorse economically available to the buying public.

Still yet another object of the present invention is to provide a new sawhorse which provides in the apparatuses and methods of the prior art some of the advantages thereof, while simultaneously overcoming some of the disadvantages normally associated therewith.

Still another object of the present invention is to provide a new sawhorse for supporting items thereon.

Yet another object of the present invention is to provide a new sawhorse which includes an elongate cross bar and a plurality of legs. The cross bar has a pair of opposite ends, top and bottom faces, and a pair of side faces. Each end of the cross bar has a pair of downwardly sockets thereadjacent. Each of the legs is associated with a corresponding socket. The legs each have a deployed position where an end of the respective leg is inserted into the associated corresponding socket such that the legs downwardly extend from the cross bar. Each side face of the cross bar has an elongate channel therein. The legs also have a stored position where a first pair of legs of the plurality of legs are inserted into one of the elongate channels and a second pair of legs of the plurality of legs are inserted into the other of the elongate channels.

Still yet another object of the present invention is to provide a new sawhorse that is collapsible for easy transport and compact storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new sawhorse embodying the principles and concepts of the present invention will be described.

As best illustrated in FIGS. 1 through 4, the sawhorse generally comprises an elongate cross bar and a plurality of legs. The cross bar has a pair of opposite ends, top and bottom faces, and a pair of side faces. Each end of the cross bar has a pair of downwardly sockets thereadjacent. Each of the legs is associated with a corresponding socket. The legs each have a deployed position where an end of the respective leg is inserted into the associated corresponding socket such that the legs downwardly extend from the cross bar. Each side face of the cross bar has an elongate channel therein. The legs also have a stored position where a first pair of legs of the plurality of legs are inserted into one of the elongate channels and a second pair of legs of the plurality of legs are inserted into the other of the elongate channels.

In closer detail the sawhorse includes an elongate cross bar 10 having has a pair of opposite ends, substantially planar top and bottom faces 11,12, and a pair of side faces. In one illustrative embodiment, the cross bar may have a length defined between the ends of the cross bar of about 32 inches.

Figure 4:
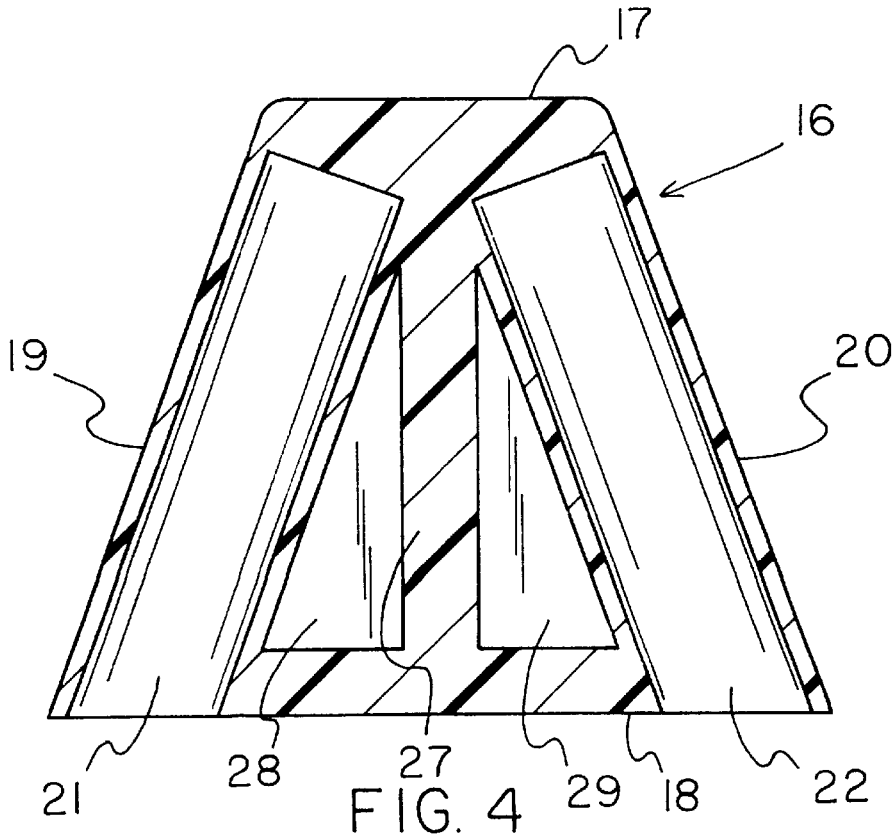
FIG. 4 is a schematic cross sectional view of an end portion taken from line 4—4 of FIG. 2.

In one embodiment, each of the ends of the cross bar may have a generally trapezoidal end portion 13,14. With reference to FIG. 4, the end portions of the cross bar may each have a top end 17 coplanar with the top face of the cross bar and a bottom end 18 coplanar with the bottom face of the cross bar. The end portions of the cross bars may each also have a pair of sides 19,20 converging towards each in a direction from the bottom end to the top end of the respective end portion. In one such embodiment, the sides of each end portion may be extended at an acute angle to one another.

The bottom end of each end portion has a pair of generally cylindrical sockets 21,22 therein. One of the sockets of each end portion may be extended substantially parallel to one side of the respective end portion and the other of the sockets of each end portion may be extended substantially parallel to the other side of the respective end portion.

The sawhorse also includes a plurality of elongate legs 23*a*,23*b*,23*c*,23*d* each having a pair of opposite ends. In one embodiment, each leg may be tubular. Each leg may also have a generally circular transverse cross section. Each leg may also comprise a metal material such as aluminum.

The legs each have a deployed position where each of the legs is associated with a corresponding socket of the end portions. In the deployed position, one end of each leg is removably inserted into the associated corresponding socket of the end portions such that the legs downwardly and outwardly extend from the end portions of the cross bar. The other end of each leg is designed for resting on a resting surface when the legs are in the deployed position. Optionally, this other end of each leg may have a resiliently deformable stop 24 coupled thereto to frictionally enhance contact with the resting surface.

Figure 3:
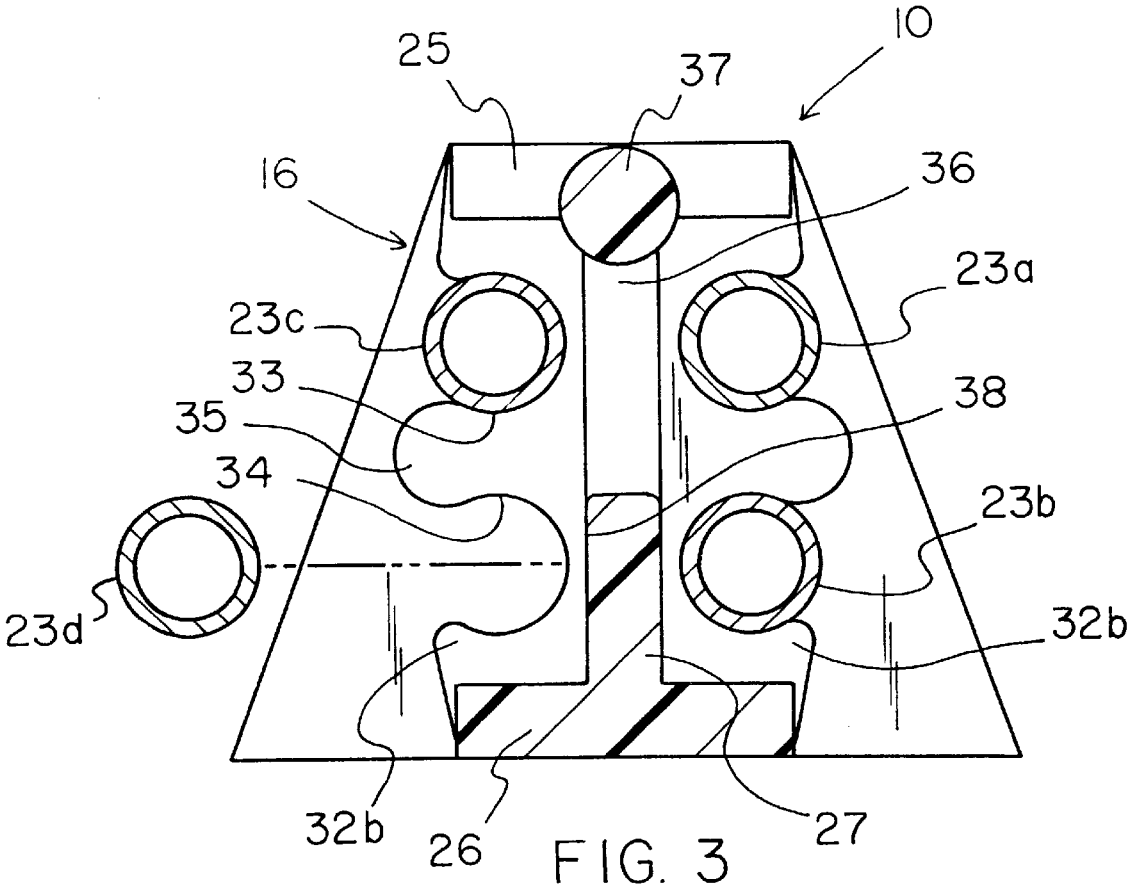
FIG. 3 is a schematic cross sectional view of the present invention taken from line 3—3 of FIG. 2 with the legs in the stored position.

As best illustrated in FIG. 3, the cross bar may have a generally I-shaped transverse cross section and comprises spaced apart and substantially planar horizontal elongate top and bottom portions 25,26 extending between the ends of the cross bar, and a substantially planar elongate vertical middle portion 27 (or webbing portion) interposed between the top and bottom portions of the cross bar and extending between the ends of the cross bar.

The top portion of the cross bar is positioned adjacent and defines the top face of the cross bar. The bottom portion of the cross bar is positioned adjacent and defines the bottom face of the cross bar. The top and bottom portions of the cross bar may lie in substantially parallel planes with the middle portion of the cross bar lying in a plane substantially perpendicular to the planes of the top and bottom portions of the cross bar.

As illustrated in FIG. 4, the end portions may each have a pair of triangular spaces 28,29 formed between the sockets of the respective end portion and middle portion of the cross bar for decreasing the weight of each end portion without loosing structural strength.

The top, bottom and middle portions of the cross bar defining a generally U-shaped elongate channel 30,31 in each of the side faces of the cross bar extending between the ends of the cross bar. The elongate channels of the side faces each may have a spaced apart pair of resilient mounting clips 32*a*,32*b* therein outwardly extending from the middle portion of the cross bar. The mounting clips may be coupled to the top, bottom and middle portions of the cross bar and may also lie in substantially parallel vertical planes with one another.

Each mounting clip has a pair of outwardly facing generally C-shaped retaining spaces 33,34 and an outwardly extending bulbous middle extent 35 interposed between the pair of retaining spaces. In one embodiment, the retaining spaces of one mounting clip of each side face each may be coaxially aligned with associated corresponding retaining spaces of the other mounting clip of the respective side face.

Figure 1:
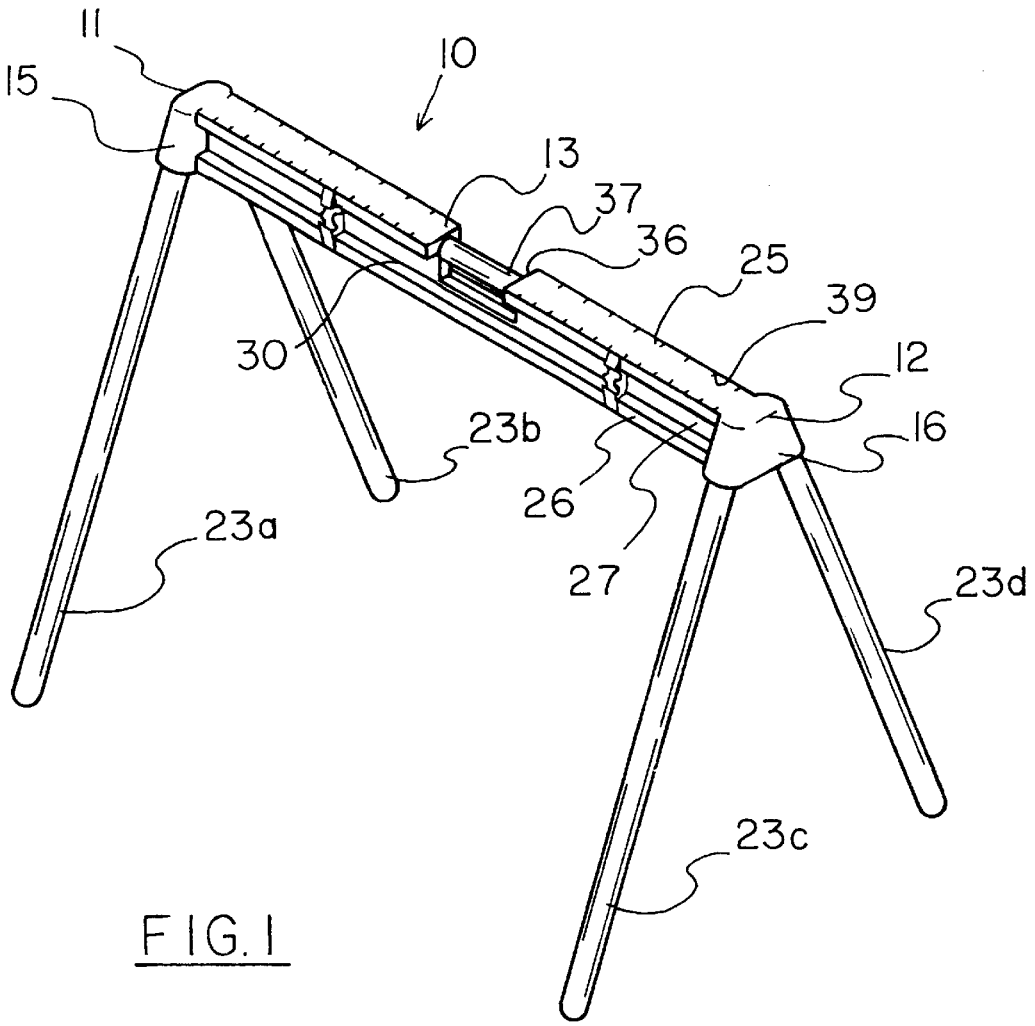
FIG. 1 is a schematic perspective view of a new sawhorse with the legs in a deployed position.
Figure 2:
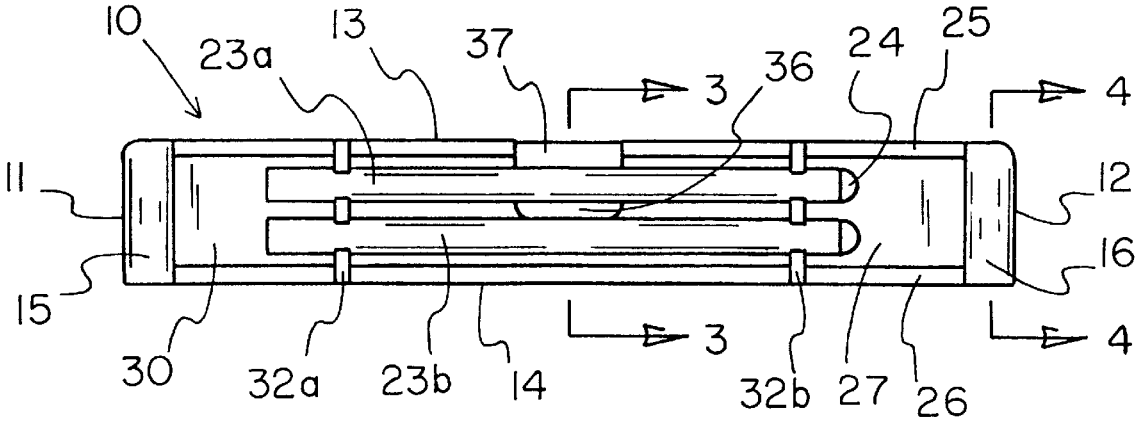
FIG. 2 is a schematic side view of the present invention with the legs in a stored position.

With reference to FIGS. 2 and 3, the legs have a stored position. The stored positioned is designed for compacting the sawhorse for storage and for easier transport. In the stored position a first pair of legs of the plurality of legs are inserted into tone of the elongate channels and a second pair of legs of the plurality of legs are inserted into the other of the elongate channels. Each leg is associated with a pair of associated corresponding retaining spaces of the mounting clips in the respective elongate channel. Each leg is removably inserted into the pair of associated corresponding retaining spaces when the respective leg is in the stored position such that the respective leg is held to the cross bar in the respective elongate channel.

The cross bar may have an upper cutout 36 extending through the top portion and into middle portion of the cross bar. The upper cutout may be positioned substantially equidistant between the ends of the cross bar. The cross bar has a generally cylindrical handle 37 extending across the upper cutout and coupled to the cross bar at both ends of the upper cutout. As best shown in FIG. 3, the handle may be positioned adjacent the top face of the cross bar and spaced apart from a bottom periphery 38 of the upper cutout formed by the middle portion of the cross bar. In use, the handle is designed for easy lifting and carrying of the sawhorse.

The top face of the cross bar may include calibrated measuring indicia 39 displayed thereon for permitting a user to use the indicia to measure items therewith. The measuring indicia may include metric and/or imperial measuring units.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sawhorse, comprising:

an elongate cross bar having a pair of opposite ends, top and bottom faces, and a pair of side faces;

a pair of downwardly sockets in said cross bar positioned adjacent to each of said ends;

a plurality of elongate legs;

each of said legs being associated with a corresponding socket;

said legs each having a deployed position wherein an end of the respective leg is inserted into the associated corresponding socket such that said legs downwardly extend from said cross bar;

each side face of said cross bar having an elongate channel therein; and said legs having a stored position wherein a first pair of legs of said plurality of legs are inserted into one of said elongate channels and a second pair of legs of said plurality of legs are inserted into the other of said elongate channels;

wherein said cross bar has an upper cutout in extending through said top face and into the channeled side faces of said cross bar, wherein said cross bar has a handle extending across said upper cutout for permitting a user to lift the cross bar with a hand gripping said handle in said upper cutout when said legs are in said deployed position and said stored position.

2. The sawhorse of claim 1, wherein each of said ends of said cross bar has an end portion, said sockets adjacent each end of said cross bar being located in a bottom face of the adjacent associated end portion.

3. The sawhorse of claim 2, wherein said end portions of said cross bar each have a top end coplanar with said top face of said cross bar and a bottom end coplanar with said bottom face of said cross bar, and wherein said end portions of said cross bars each have a pair of sides converging towards each in a direction from said bottom end to said top end of the respective end portion.

4. The sawhorse of claim 1, wherein each leg is tubular.

5. The sawhorse of claim 1, wherein said cross bar has a generally I-shaped transverse cross section and comprises spaced apart and substantially planar elongate top and bottom portions extending between said ends of said cross bar, and a substantially planar elongate middle portion interposed between said top and bottom portions of said cross bar and extending between said ends of said cross bar, wherein said top, bottom and middle portions of said cross bar define said elongate channels of said cross bar.

6. The sawhorse of claim 1, wherein elongate channels of said side faces each have at least one mounting clip therein, said mounting clip having a pair of outwardly facing retaining spaces, wherein said legs are inserted into an associated retaining space when said legs are in said elongate channels when in said stored position.

7. The sawhorse of claim 1, wherein said handle does not extend above the top face of said cross bar such that the handle does not restrict movement of work pieces on said top face.

8. The sawhorse of claim 1, wherein said handle being positioned adjacent to and substantially flush with said top face of said cross bar for preventing work pieces rested on said cross bar from falling into said upper cutout.

9. A sawhorse, comprising:

an elongate cross bar having a pair of opposite ends, substantially planar top and bottom faces, and a pair of side faces;

each of said ends of said cross bar having a generally trapezoidal end portions;

said end portions of said cross bar each having a top end coplanar with said top face of said cross bar and a bottom end coplanar with said bottom face of said cross bar;

said end portions of said cross bars each having a pair of sides converging towards each in a direction from said bottom end to said top end of the respective end portion;

said sides of each end portion being extended at an acute angle to one another;

said bottom end of each end portion having a pair of generally cylindrical sockets therein;

one of said sockets of each end portion being extended substantially parallel to one side of the respective end portion, the other of said sockets of each end portion being extended substantially parallel to the other side of the respective end portion;

a plurality of elongate legs each having a pair of opposite ends;

wherein each leg is tubular;

each of said legs being associated with a corresponding socket of said end portions;

said legs each having a deployed position wherein one end of each leg is inserted into the associated corresponding socket of said end portions such that said legs downwardly and outwardly extend from said end portions of said cross bar;

said cross bar having a generally I-shaped transverse cross section and comprising spaced apart and substantially planar elongate top and bottom portions extending between said ends of said cross bar, and a substantially planar elongate middle portion interposed between said top and bottom portions of said cross bar and extending between said ends of said cross bar;

said top and bottom portions of said cross bar being lying in substantially parallel planes, said middle portion of said cross bar lying in a plane substantially perpendicular to said planes of said top and bottom portions of said cross bar;

said top portion of said cross bar being positioned adjacent and defining said top face of said cross bar, said bottom portion of said cross bar being positioned adjacent and defining said bottom face of said cross bar;

said top, bottom and middle portions of said cross bar defining a generally U-shaped elongate channel in each of said side faces of said cross bar extending between said ends of said cross bar;

elongate channels of said side faces each having a spaced apart resilient mounting clips therein outwardly extending from said middle portion of said cross bar;

each mounting clip having a pair of outwardly facing generally C-shaped retaining spaces;

said retaining spaces of one mounting clip of each side face each being coaxially aligned with associated corresponding retaining spaces of the other mounting clip of the respective side face;

said legs each having a stored position wherein a first pair of legs of said plurality of legs are inserted into one of said elongate channels and a second pair of legs of said plurality of legs are inserted into the other of said elongate channels;

each leg being associated with a pair of associated corresponding retaining spaces of said mounting clips in the respective elongate channel;

each leg being inserted into said pair of associated corresponding retaining spaces when the respective leg is in said stored position such that the respective leg is held to said cross bar in the respective elongate channel;

said cross bar having an upper cutout extending through said top portion and into middle portion of said cross bar, said upper cutout being positioned substantially equidistant between said ends of said cross bar;

said cross bar having a handle extending across said upper cutout; and said handle being positioned adjacent said top face of said cross bar.

* * * * *